United States Patent [19]

Nunlist

[11] Patent Number: 4,532,885

[45] Date of Patent: Aug. 6, 1985

[54] APPARATUS FOR APPLYING INTERNAL COATINGS IN HOT VESSELS

[75] Inventor: Erwin J. Nunlist, Penfield, N.Y.

[73] Assignee: Kennecott Corporation, Cleveland, Ohio

[21] Appl. No.: 668,587

[22] Filed: Nov. 5, 1984

[51] Int. Cl.[3] ..... B05B 7/00; B05B 5/00

[52] U.S. Cl. ..... 118/308; 118/317; 118/318; 239/683; 239/676; 239/687

[58] Field of Search ..... 118/308, 318; 239/683, 239/676, 687, 132.3, 132.1, 672, 184, 178

[56] References Cited

U.S. PATENT DOCUMENTS

| | | | |
|---|---|---|---|
| 2,243,996 | 6/1941 | Baughman | 239/687 |
| 3,109,657 | 11/1963 | Dreyer | 239/683 |
| 3,472,201 | 10/1969 | Quackenbush | 118/308 |
| 3,533,375 | 10/1970 | McConnell | 118/308 X |

FOREIGN PATENT DOCUMENTS

| | | | |
|---|---|---|---|
| 800491 | 12/1968 | Canada | 239/687 |

*Primary Examiner*—Shrive P. Beck
*Attorney, Agent, or Firm*—R. Lawrence Sahr

[57] ABSTRACT

The present invention provides an apparatus for distributing a stream of solidifiable, finely divided, vitreous coating material onto a heated internal surface of a concave article, such as a tank or a reaction vessel, to form a smooth, uniform, continuous, fused coating thereon. The apparatus consists of a horizontally mounted disc rotor which has a plurality of radially directed vanes mounted thereon. The vanes extend short of the rotor center defining a central chamber. The central chamber contains a cylindrical particle directing cage. The cage has a hollow central impeller, coaxially aligned, and spacedly positioned therein. The impeller is connected with the rotor by a common rotatable shaft. A supply of finely divided vitreous material is fed into the hollow of the impeller and directed through openings in the impeller into the cage member. The rotation of the impeller within the cage member extrudes a metered supply of the feed material through a discharge opening in the cage member into the vane area and rotation of the vanes centrifugally distributes the feed material in an outward direction toward the surface to be coated.

5 Claims, 2 Drawing Figures

APPARATUS FOR APPLYING INTERNAL COATINGS IN HOT VESSELS

BACKGROUND OF THE INVENTION

The present invention relates to an apparatus for applying coatings. The apparatus is adapted to apply a supply of solidifiable, finely divided vitreous coating material, such as glass, or enamel, to the internal surface of a heated, horizontally rotating, cylindrical article, such as a vessel, or tank to form a smooth, uniform, continuous, fused coating thereon.

Glass lined vessels have found widespread use in numerous industries, particularly those industries which require the storage or reaction of corrosive materials. Such vessels find use in extraction, suspension and distillation processes. The glass lining facilitates the use of the vessels under adverse temperature and corrosive conditions.

Various methods and apparatus have been proposed to apply internal coatings to tubular articles, such as reactors. Typical examples of these are: U.S. Pat. Nos. 3,351,289; 3,484,266; 3,827,633; 3,876,190, and 4,150,176. Generally booms, or lances, consisting of an elongated tubular member are utilized. Coating material is fed in one end, transported through the tube portion, to and through, a distribution means located in the end of the boom positioned within the article being coated. As the boom moves through the length of the article, the interior of the article is coated.

In coating vitreous material, such as glass, on steel, it is imperative that an integral coating be obtained. Small defects, such as areas not coated completely, pinholes, blisters, or abrasions, result in rapid deterioration of the substrate in the defective area, especially when the coated article is subjected to corrosive conditions. Methods of distributing particles into a heated article utilizing a fluid carrier, such as air, are generally not adaptable to use in coating processes using vitreous materials as the fluid flow within the article being coated carries particles to undesired locations, causes detrimental localized cooling and results in a substantial amount of suspended particulate material being lost in the exiting flow.

The most widely used prior art method of applying a vitreous coating to the interior of an article involves the room temperature surface application of particulate vitreous material in a carrier, such as water. After the mixture is applied, the article is dried to remove the carrier and subsequently fired. This process is repeated several times to obtain the desired coating thickness. Most prior art processes, such as U.S. Pat. No. 3,484,266, noted above, initially distribute particulate materials on the vessel surface and subsequently in a separate step fuse the particles to obtain the finished coating. The reason a subsequent, and separate, firing step is required, is that mechanical apparatus, such as mechanisms to feed and distribute particulate glass, do not reliably operate at glass firing temperatures. Typically, such temperatues range between about 1500° and about 1850° F. At such temperatures, the particulate feed material frequently becomes tacky and difficult to feed or distribute. The result frequently is an uneven or otherwise defective coating.

U.S. Pat. No. 3,788,874 teaches a method of glass coating by maintaining the article to be coated at a temperature at least as high as the fusion point of the glass, while depositing glass particles on the article at a rate no greater than the rate at which the particles fuse to the article. While this method has many advantages it has not been widely utilized on a commercial basis because equipment to facilitate the commercial use of the method has not been developed. The present invention provides a particle distributing means by which the method of U.S. Pat. No. 3,788,874 may be carried out. The teachings of U.S. Pat. No. 3,788,874 are incorporated herein by reference.

BRIEF DESCRIPTION OF THE INVENTION

The present invention provides an apparatus for distributing a stream of solidifiable, finely divided, vitreous coating material onto a heated internal surface of a concave article, such as a tank or a reaction vessel, to form a smooth, uniform, continous, fused coating thereon. The apparatus consists of a substantially horizontal disc rotor which has a plurality of radially directed vanes mounted thereon. The vanes are adapted to spread or distribute finely divided vitreous material centrifugally in an outward direction.

The vanes extend short of the rotor center providing and defining a central chamber. The central chamber contains a cylindrical particle directing cage. The cage has a hollow central impeller, coaxially aligned, and spacedly positioned therein.

The cylindrical cage has a discharge opening positioned along its lower, or bottom, periphery connecting with the vane area of the rotor. The discharge opening is adapted to meter a supply of finely divided vitreous material therethrough and direct such material to the vane area of the rotor.

The impeller, positioned within the cage member, has a plurality of openings in its lower periphery and is connected with the rotor by a common rotatable shaft. The shaft extends upward through the central chamber.

A supply of finely divided vitreous material is fed into the hollow of the impeller and directed through the openings in the impeller into the cage member. The rotation of the impeller within the cage member extrudes a metered supply of finely divided vitreous material through the discharge opening of the cage member into the vane area. The rotary motion of the vanes distributes the particulate feed material in an outward direction toward the surface to be coated.

The present apparatus facilitates the distribution of a finely divided vitreous material, such as glass or enamel, on the internal surface of a horizontally rotating cylindrical article, such as a tank or other type vessel. The tank or vessel is heated to the fusion point of the vitreous material or above, usually temperatues of 1500° F. or above. The finely divided vitreous material directed to the internal surface fuses thereon forming a smooth, uniform, continuous coating. The coating may be a ground or a cover coat, or may be a combination of coats.

The finely divided vitreous material, for example, glass frit, is fed at a rate no greater than that at which the particles fuse to the interior wall of the article being coated. Preferably a particulate glass frit is utilized as the finely divided vitreous material. Such frit typically has at least about 90 percent of its particles ranging between about 20 US mesh and about 325 US mesh, with a preferred size range from about −60 to +200 US mesh.

The time required to coat an article is dependent upon a number of factors, such as the internal surface area of the article being coated, the rotation speed of the article, the particle size, formulation, and distribution rate of the finely divided vitreous material, and the desired coating thickness. Deposition rates in the area covered of up to about 15 mils thickness per minute are generally satisfactory, however, slightly slower rates, from about 5 to about 10 mils per minute are preferred.

The present apparatus facilitates the coating of articles having ends, such as vessel tops and bottoms, wherein the particles must be cast in a horizontal stream for a distance sufficient to impinge upon the heated end area. The metering action of the particle directing cage member preferably maintains a supply of particulate feed material in the vane area sufficient to obtain the outward horizontal stream path required for such end coating while supplying the feed material at a rate no faster than the material is being uniformly distributed within the article.

DETAILED DESCRIPTION AND PREFERRED EMBODIMENT OF THE INVENTION

The present invention will not be described in reference to the attached drawings in which similar components are denoted by corresponding numbers.

Figure 1:
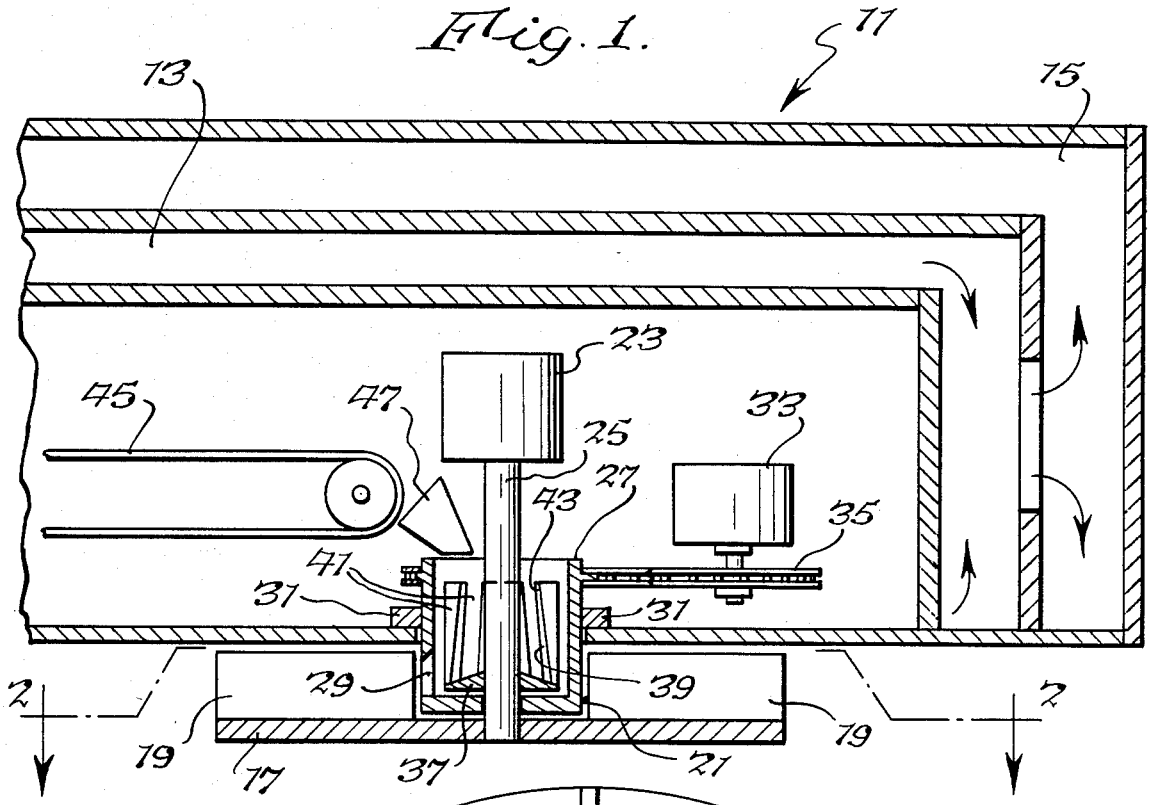
FIG. 1 is a side elevation view, partly in cross-section, of the present distribution apparatus as it would appear installed in a feed boom.

Looking now at the figures, the present distribution, or spreading, apparatus is shown positioned within an elongated annular boom generally denoted as 11. Such boom is adapted to be inserted into a heated, cylindrical article, such as a tank or vessel, to facilitate the distribution of particulate vitreous material to various locations in the inside of the article. The present invention is particularly suited to use in the boom device described in commonly owned U.S. patent application Ser. No. 668,589, entitled "Method and Apparatus for Applying Internal Coatings to Vessels", filed of even date herewith. The disclosure of which is hereby incorporated by reference.

Boom 11 is suitably cooled by circulation of a cooling medium, such as air, circulated through ducts, such as 13 and 15. Typical circulation is shown by the directional arrows. The temperature within the article being coated is sufficient to fire glass. Generally glass firing temperatures range from about 1500° to about 1850° F. Typically, the external surface of the boom is insulated and with the circulation of a cooling medium, the internal temperature of the boom is maintained at about 200° F.

The distribution apparatus comprises a substantially horizontal disc rotor 17 having a plurality of radially directed vanes 19 mounted thereon. The vanes are adapted to centrifugally distribute finely divided vitreous material in an outward direction. Although the vanes are shown as substantially straight, it will be understood that they may be curved in a forward manner to give a scooping action, or curved backward to impart a greater centrifugal force to the particles of vitreous material. The number of vanes may vary, from four to eight are particularly useful. Less than four generally does not give a smooth or regular delivery of particles and greater than eight may provide undue and undesired air circulation within the article.

Vanes 19 extend short of the center portion of rotor 17 to define a central chamber, generally denoted as 21. Rotor 17 is rotatably connected to a motor means 23 by means of a shaft 25 extending through central chamber 21.

A cylindrical cage 27, coaxially mounted with, but stationary with respect to rotor 17, is positioned within chamber 21. Particle directing cage 27 has a discharge opening 29 positioned along the bottom portion of its periphery. Discharge opening 29 is adapted to meter a supply of finely divided vitreous material therethrough and direct such material to the vane area of rotor 17. Discharge opening 29, along with the speed at which the rotor turns, determines the fanning angle of the particles and the density of the coating being applied. While opening 29 may be of any contour, e.g. square, rectangular, triangular, or circular, it is preferred that it be a horizontal slit in the lower or bottom periphery of the cage. It is also desirable that the internal wall portion of cage 27 taper outward where discharge opening 29 is located. This configuration provides a means of metering of finely divided material by extrusion through opening 29. Cage 27 is moveable about its axis within chamber 21 to facilitate the positioning of discharge opening 29 at various locations around the periphery of central chamber 21. Suitably cage 27 is mounted on bearings, such as 31 and connected to a rotational means, such as stepping motor 33 by a drive, such as chain drive 35.

Figure 2:
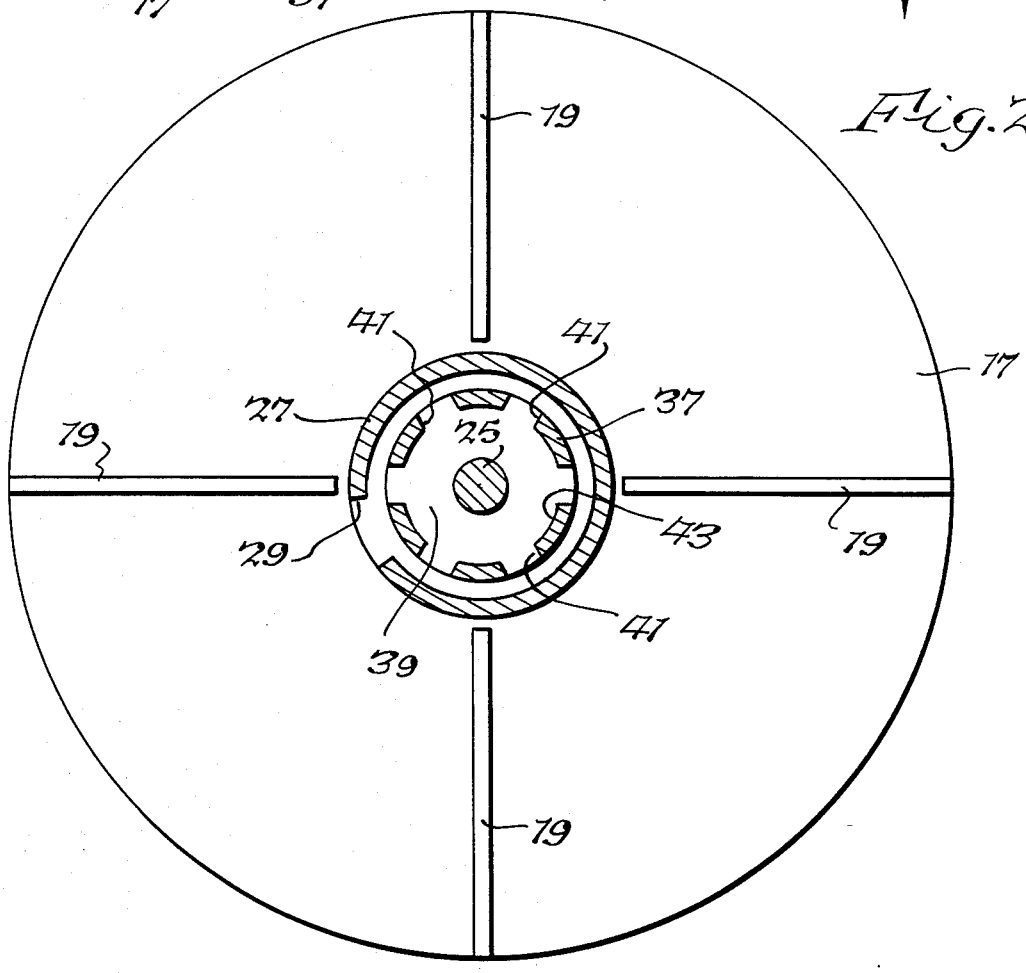
FIG. 2 is a top elevation view taken along lines a—a' of FIG. 1.

A hollow central impeller 37 is spacedly positioned within cage 27 and is connected for rotation with rotor 17. Impeller 37 is adapted to receive a supply of finely divided vitreous material within the hollow portion 39 and feed such material through openings, such as 41 (shown best in FIG. 2) into the internal portion of cage 27. The internal portions of wall 43 of impeller 37 are preferably angled inward to facilitate outward flow of particulate material, i.e. the wall thickness along the top portion of impeller 41 is greater than the wall thickness along the bottom. Inward angles of from about 20° to about 40° have been found to be particularly useful.

A supply of finely divided vitreous material is suitably transported by a belt conveyor, such as 45, or alternatively by an auger or screw feed arrangement, from a supply hopper, or other source, fed through the length of boom 11 and directed into impeller 41 suitably by a funnel, such as 47.

Rotor 17 and impeller 41 are rotated by a motor means 23. It will be understood that motor means 23 may be direct drive or may be a right angle gear box having a flexible shaft extending outward of boom 11.

It will be appreciated that the foregoing specification and accompanying drawings are set forth by way of illustration and not limitation, and that various modifications and changes may be made therein without departing from the spirit and scope of the present invention which is to be limited solely by the scope of the appended claims.

What is claimed is:

1. An apparatus for distributing a stream of solidifiable finely divided vitreous coating material onto a heated internal surface of a concave article which comprises:

(a) a substantially horizontal disc rotor having a plurality of radially directed vanes thereon for centrifugally outward distributing finely divided vitreous material, (b) said vanes extending short of the rotor center portion, defining a central chamber, (c) said rotor rotatably connected to a motor means by a shaft extending through said central chamber, (d) a cylindrical cage means positioned within said central chamber having a discharge opening positioned along the bottom periphery thereof adapted to meter a supply of finely divided vitreous material to the vane area of said rotor, (e) means to rotate said cage means within said chamber to move said discharge opening, (f) a hollow central impeller connected for rotation with said rotor spacedly positioned within said cage means, said impeller having a plurality of openings in the lower periphery thereof adapted to receive a supply of finely divided vitreous material from said hollow area and feed such material into said cage means, and (g) a means for supplying finely divided vitreous material to the hollow portion of said impeller.

2. The apparatus of claim 1 wherein 90% of said finely divided vitreous material ranges between about 20 and about 325 US mesh in size.

3. The apparatus of claim 2 wherein said finely divided vitreous material is glass frit.

4. The apparatus of claim 1 wherein said heated internal surface is a temperature sufficient to fire glass.

5. The apparatus of claim 1 wherein said heated internal surface ranges in temperature between about 1500° and 1850° F.

* * * * *